United States Patent [19]

MacLeod

[11] Patent Number: 4,462,763

[45] Date of Patent: Jul. 31, 1984

[54] HYDRAULIC PUMP JACK

[76] Inventor: Donald I. MacLeod, 41 Phelps St., Geraldton, 6530, State of Western Australia, Australia

[21] Appl. No.: 381,868

[22] Filed: May 25, 1982

[30] Foreign Application Priority Data

Mar. 24, 1982 [AU] Australia ..... 3291/82

[51] Int. Cl.[3] ..... F04B 47/08

[52] U.S. Cl. ..... 417/378; 417/390; 417/403

[58] Field of Search ..... 417/378, 278, 383, 390, 417/403, 404

[56] References Cited

U.S. PATENT DOCUMENTS

| | | | |
|---|---|---|---|
| 1,922,264 | 8/1933 | Shimer | 417/378 |
| 2,051,243 | 8/1936 | Bowling | 417/383 |
| 3,128,711 | 4/1964 | Voight et al. | 417/317 |

FOREIGN PATENT DOCUMENTS

| | | | |
|---|---|---|---|
| 239991 | 1/1961 | Australia | 417/403 |

*Primary Examiner*—Leonard E. Smith

*Attorney, Agent, or Firm*—Pearne, Gordon, Sessions, McCoy, Granger & Tilberry

[57] ABSTRACT

A hydraulic pump jack for hydraulically actuated well pumps of the general type having pistons driven in one direction to lift liquid up a delivery pipe and having the pistons returned to recharge the said pump, comprising a double-acting surface pump with one pump section arranged to communicate with a liquid delivery pipe extending up the well and the other section arranged to communicate with a pump control pipe which also extends up the well, and valve means connected to the said control pipe to open the delivery pipe to allow an outflow of liquid from the delivery pipe during the pressure stroke of the pump section connected to the said control pipe.

6 Claims, 3 Drawing Figures

HYDRAULIC PUMP JACK

FIELD OF THE INVENTION

This invention relates to an improved hydraulic pump jack and also to a system of operating a pump in a well which is connected only by liquid lines to a pump jack at the head of the well.

THE PRIOR ART

It used to be customary to operate pumps at the bottom of a well from a windmill or other source by having a mechanical rod passing down the water delivery pipe to provide a mechanical connection between the power source and the pump.

This of course gave rise to many problems when servicing of a pump was required as it was necessary not only to withdraw the actuating line which passed down the water delivery pipe but also the water delivery pipe to which the pump was attached.

According to earlier inventions of mine a method and means was developed which required only pipe connections to the pump and no pump rod was involved, thus greatly facilitating servicing and withdrawal of the pump from a bore or well.

According to an earlier specification of mine which is application No. PE 2440 dated the 19th February, 1980, (67159/81), this improved system was used and that was based on a pump having a pair of cylinders arranged co-extensively and co-axially within which were a pair of pistons coupled by a hollow pump rod provided with the necessary valve means to cause the pistons to move up and down under control of a surface pump jack.

The method of operation in that is to have a head of water in the water delivery pipe higher than the pump jack which comprises a single cylinder with a piston driven by any suitable means to force water down a control pipe, at the appropriate time, to manipulate the pistons to force water up the water delivery pipe, but on the opposite stroke of the pump jack the head of water in the delivery pipe provided the means for forcing the pistons into their retracted position in readiness for the next lifting stroke.

SUMMARY OF THE INVENTION

The present invention relates to certain improvements to this type of system which has been devised specifically to remove the need to have a head of liquid in the delivery pipe higher than the pump jack and this is achieved by utilizing a double acting pump jack which is coupled to both the control pipe and the liquid delivery pipe in such a manner that as the pistons in the hydraulic pump jack are actuated, the pump at the base of the well is correspondingly moved to ensure a highly effective pumping action.

Thus the invention consists of a pump jack for a hydraulically actuated well pump of the general type having pistons driven in one direction to lift liquid up a delivery pipe and having the pistons returned to recharge the pump, comprising a double acting pump with one pump section arranged to communicate with a liquid delivery pipe extending up the well, and the other section arranged to communicate with the pump control pipe which also extends up the well, and control valve means connected to the control pipe to open the delivery pipe to allow an outflow of liquid from the delivery pipe during the pressure stroke of that pump section connected to the control pipe.

DETAILED DESCRIPTION OF PREFERRED EMBODIMENTS

Figure 1:
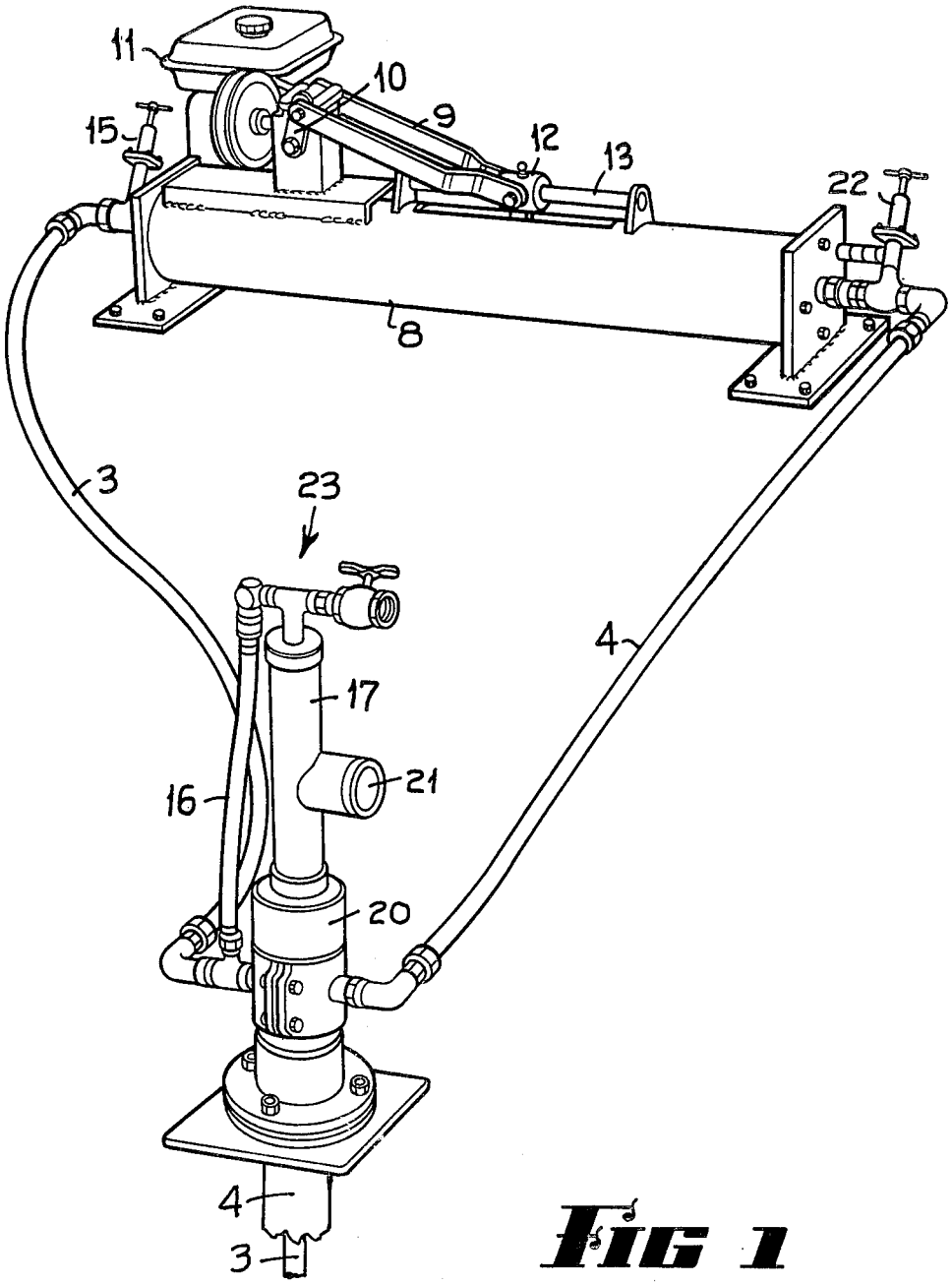
FIG. 1 is a perspective view of one form of the invention showing the pump connected to the valve means at the head of the well.
Figure 2:
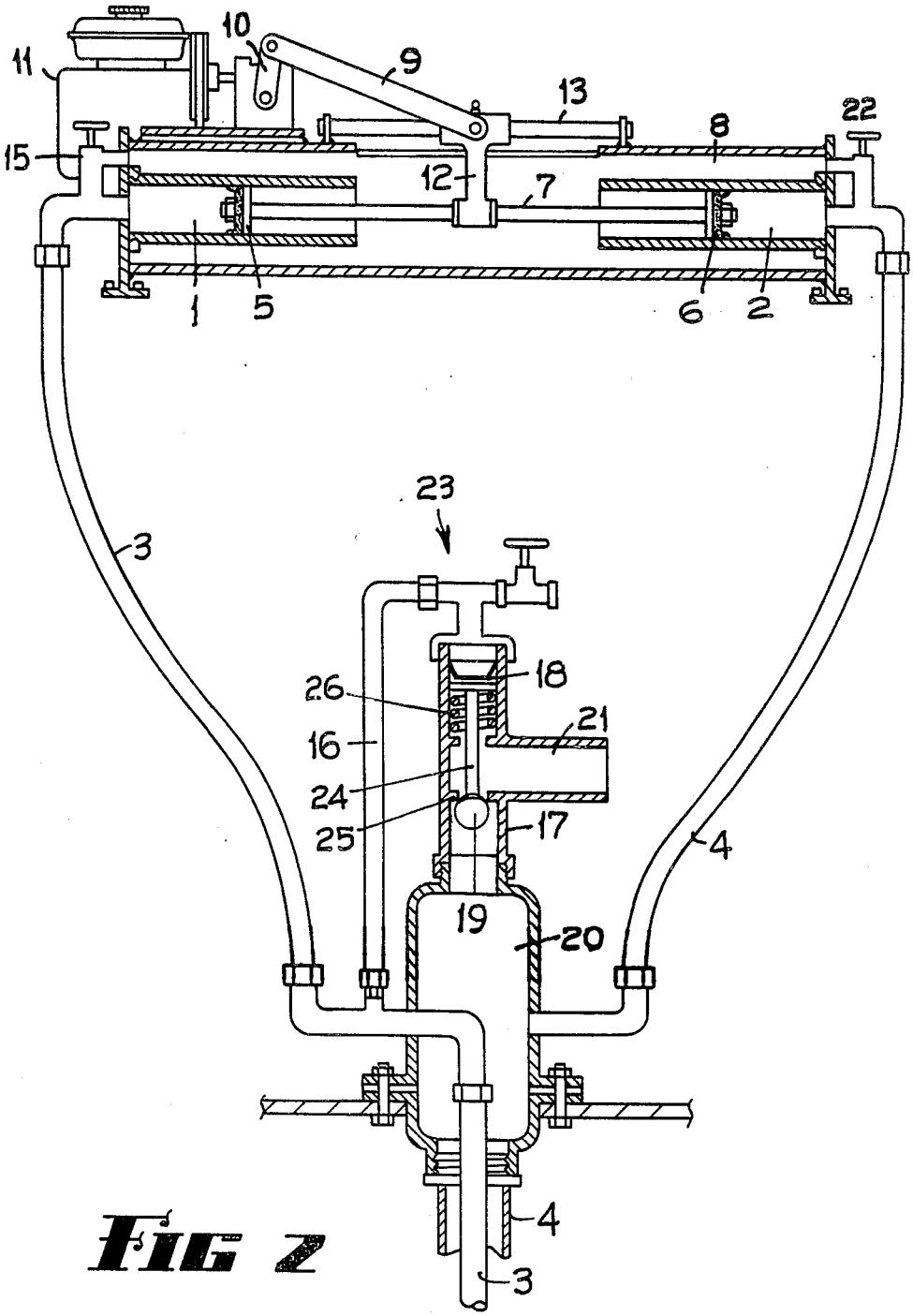
FIG. 2 is a somewhat schematic sectional view of same.

The hydraulic pump jack can be formed in various ways, but in the form shown in FIGS. 1 and 2 it comprises a pair of cylinders 1 and 2, the first cylinder 1 being connected to the control pipe 3, the second cylinder 2 being connected to the liquid delivery pipe 4.

The pistons 5 and 6 in the two cylinders 1 and 2 are connected together by a rod 7 to operate oppositely, that is to say when one forces liquid out of its cylinder the other is moving back to allow liquid into its cylinder, the two cylinders 1 and 2 being mounted in a reservoir 8 containing liquid in which the two pumps are submerged and having a connecting rod 9 coupled to a crank mechanism 10 of driving means 11 to reciprocate the rod 7, the connecting rod 9 transmitting motion through a cross-head 12 slidable on a guide rod 13.

The cylinders 1 and 2 can be either horiontally arranged in the reservoir 8 or they can be vertically arranged to fit immediately above the bore or well as will be described with reference to FIG. 3, but in each case the pistons 5 and 6 of the two cylinders 1 and 2 are reciprocated by the driving means 11 which can be a windmill or other power source and regulate the movement of the coupled pistons in the pump in the well or bore.

The first cylinder 1 which is that which is connected to the control pipe 3 has a relief valve 15 so that excess liquid can be pumped back into the reservoir 8 but this control pipe 3 also has a pipe connection 16 to a secondary valve cylinder 17 forming part of the pump jack which when pressure is applied to the piston 18 in the secondary cylinder 17 opens a valve 19 in a chamber 20 to allow an outflow of liquid from the delivery pipe through the outlet 21 to a storage source or the like.

The second cylinder 2 which is that connected to the water delivery pipe 4 through the chamber 20 is also provided with a relief valve 22 so that excess liquid displaced by the piston 6 can flow back into the reservoir 8.

The invention thus has a first hydraulic cylinder 1 and a second hydraulic cylinder 2 which are connected for actuation in an alternate manner, that is to say when the piston 5 of one is displacing liquid the other piston 6 is retracting, and by this arrangement a double acting hydraulic pump jack is supplied which controls the movement of the pistons in the pump within the bore or well in a similar manner so that all that is necessary for the installation is to have the liquid delivery pipe 4 connected to the pump at the base of the well or bore and to have an outlet to a tank or the like but without requiring a head as heretofor, the actuation of the pump being under full control of the two-cylinder hydraulic pump jack so that the operation is fully controlled by the movement of the pistons 5 and 6 in the cylinders 1 and 2 assisted by the secondary valve cylinder 17 which controls the valve 19 in the chamber 20 in the liquid delivery pipe line.

The acutal construction of the control valve means, designated generally 23, can be varied but as shown comprises the secondary cylinder 17 in which is situated the piston 18 which has a rod 24 connecting down through the bore to the valve 19 which is adapted to close off flow by engaging a seating 25 under action of a pressure spring 26 urging the valve into the closed position, the spring 26 however being of such tension that liquid pressure from the first hydraulic cylinder 1 can open the valve by pressing on the piston 18 to allow an outflow from the outlet 21 of the delivery pipe 4. During the opposite stroke however this valve 19 closes.

Figure 3:
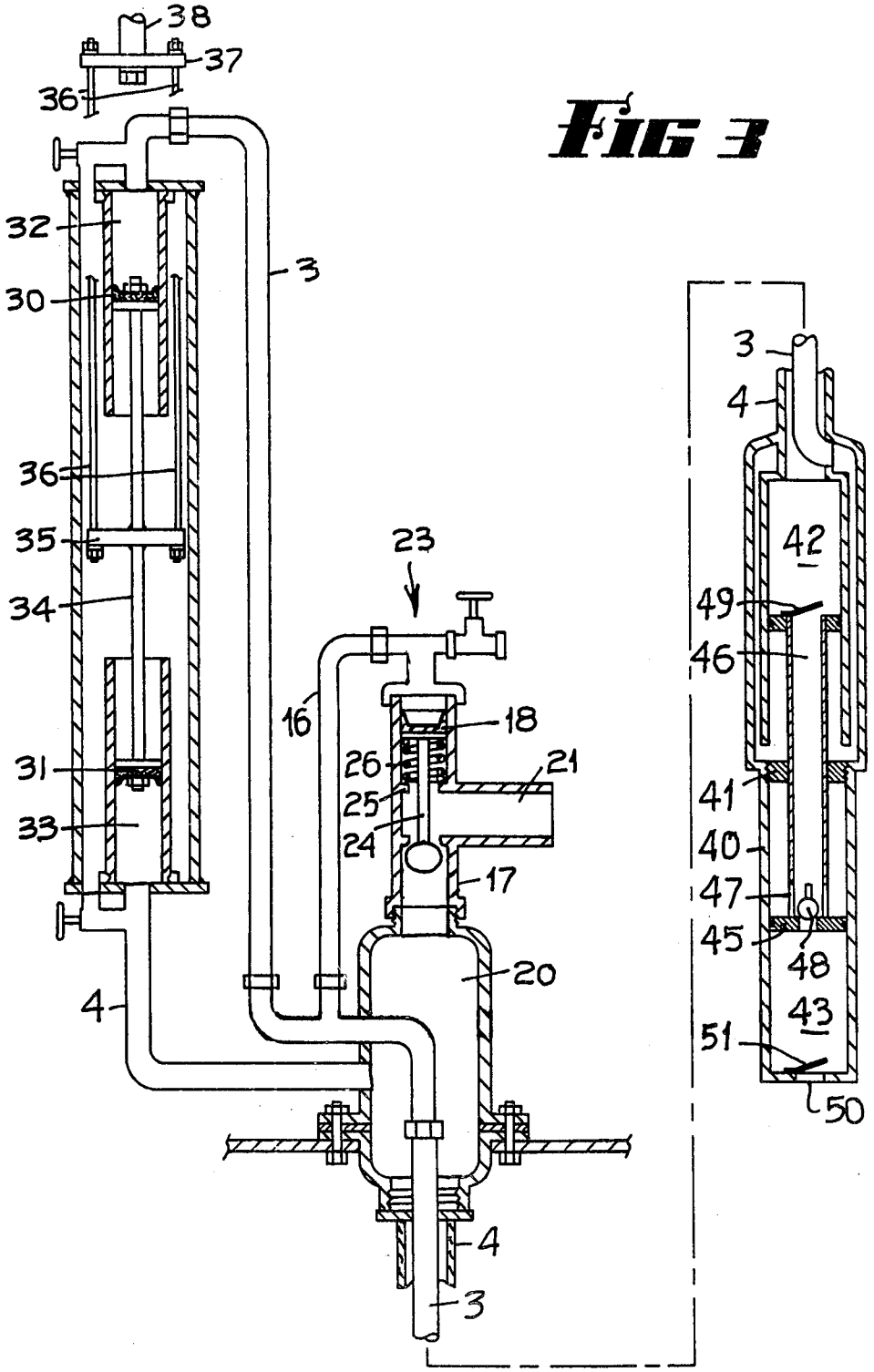
FIG. 3 is a sectional side elevation of a modified arrangement and including the liquid delivery pump at the base of a well.

By mounting this pump jack vertically it can be directly coupled to a windmill rod and can fit at the top of the liquid delivery pipe to give a highly effective form of operation which in effect acts as a double acting pump to control the two way movement of the piston or pistons in the pump in the bore or well, and such an embodiment is shown in FIG. 3 which also shows somewhat diagramatically the delivery pump at the base of the well.

Describing now the embodiment of FIG. 3 the pistons 30 and 31 are fitted into cylinders 32 and 33 and are coupled by a connecting rod 34 having a cross-head 35 connected by rods 36 to an upper cross-head 37 which connects to the pump rod 38 of a windmill or the like.

The control valve 23 can be that described in reference to FIGS. 1 and 2 and therefore similar parts are similarly numbered, as are the common pipe connections.

The cylinder 32 connects to the control pipe 3 and the cylinder 33 to the delivery pipe 4.

The delivery pump at the base of the well comprises a cylinder 40 divided at the centre by a wall 41 to form an upper chamber 42 and a lower chamber 43, the upper chamber 42 having a piston 44 in it and the lower chamber 43 having a piston 45 in it which pistons are connected together by a hollow connecting rod 46 having ports 47 placing the hollow of the rod 46 into communication with the lower chamber 43 but the piston 45 having a non-return valve 48 while a non-return valve 49 is positioned at the top of the piston 44. The bottom of the lower chamber 43 has a liquid inlet 50 with a foot valve 51.

It will be seen that the coupled pistons 44 and 45 will be caused to reciprocate under control of the pistons 30 and 31 because of their interconnection by the liquid in the control pipe 3 and the delivery pipe 4 and also because of the double piston arrangement of the pump in the well more liquid is lifted on the up stroke than is involved in the pump recharging down stroke.

From the foregoing it will be realised that a simple and effective unit is provided which forms a double-acting hydraulic pump jack which reciprocates by liquid pressure a pump at the base of the well or bore so that no mechanical connections are involved but only the two lines pass down the well or bore to the pump which can be supported by the pipes and thus can be readily removed particularly if the pipes are of a somewhat flexible nature.

The pump jack is of relatively simple construction as is the valve mechanism and relief valves provided for it and it will be realized that such a pumping system can be used not only for lifting water from a well or bore but can pump such other commodities as oil or chemicals now frequently handled by more conventional pipes and mechanisms and their attendant problems.

The claims defining the invention are as follows:

1. A hydraulic pump jack for hydraulically actuated well pumps of the general type having pistons driven in one direction to lift liquid up a delivery pipe and having the pistons returned by liquid in a control pipe to recharge the said pump, characterised by a double-acting pump having a first pump section arranged to be coupled to the said liquid delivery pipe extending up the well, and a second pump section arranged to be coupled to the said pump control pipe which also extends up the well, fluid actuated valve means in the said delivery pipe to normally stop outflow from the said delivery pipe, and means coupling the said control pipe to the said valve means to actuate the said control valve to allow an outflow of liquid from the said delivery pipe when the said control pipe is pressurised during the pressure stroke of the said first pump section.

2. A hydraulic pump jack for hydraulically actuated well pumps of the general type having pistons driven in one direction to lift liquid up a delivery pipe and having the pistons returned by liquid in a control pipe to recharge the said pump, comprising first and second pump cylinders with pistons therein interconnected to be oppositely actuated, said first pump cylinder being adapted to be connected to communicate with the said control pipe of a remote liquid delivery pump, and second pump cylinder being adapted to be connected to the said liquid delivery pipe of the said remote liquid delivery pump, and normally closed valve means connected to receive liquid from the said first pump cylinder to open the said valve means by liquid pressure, said valve means being positioned in the said delivery pipe and arranged to be opened to allow flow from the said liquid delivery pipe when the said control pipe is pressurised during the delivery stroke of the said well pump.

3. A hydraulic pump jack according to claim 1 wherein the said jack comprises a liquid reservoir having the said first and second cylinders submerged in it, said cylinders having facing open ends spaced apart, a pair of pistons in said cylinders interconnected by a connecting rod, means to reciprocate the said rod, an outlet from said first cylinder to a control pipe having a relief valve discharging back into said reservoir, and an outlet from the said second cylinder to a liquid delivery pipe and having a relief valve discharging back into said reservoir.

4. A hydraulic pump jack according to claim 1 wherein the said valve means comprise:

a secondary cylinder connected at one end to the said control pipe and at the other end to the said liquid discharge pipe, a piston within the said secondary cylinder remote from the end connected to the said liquid discharge pipe, a liquid flow control valve in the said secondary cylinder connected to move with the said piston and adapted to engage a seat in the said secondary cylinder arranged to allow flow from the said liquid discharge pipe when liquid pressure is applied to the said piston from the said control pipe, said valve being urged into a closed position by a spring.

5. A hydraulic pump jack according to claim 2 or 3 wherein the said valve means comprise a secondary cylinder connected at one end to the said control pipe and at the other end to a chamber connectable with the said liquid outlet pipe, a piston in the said secondary cylinder in communication with the said control pipe, a valve in the said secondary cylinder between the said chamber and an outlet from the said cylinder, said control pipe passing through the said chamber and into said liquid outlet pipe, said piston being connected to the said valve and loaded by spring means to urge the said valve into a closed position, and a pipe connecting the said chamber with the outlet of the said second cylinder to cause liquid to flow into the said chamber when the piston in the said second cylinder is advanced to pressurise liquid in the delivery pipe.

6. A hydraulic pump jack and pump combination arranged to be interconnected by a liquid delivery pipe and a pump control pipe comprising a surface unit having first and second pump section cylinders with pistons therein interconnected to be oppositely actuated, means to connect said first pump section to said control pipe, means to connect said second pump section to said liquid delivery pipe, and a valve connected to said control pipe to allow outflow of liquid from said liquid delivery pipe when said control pipe is pressurised, means to urge said valve closed to prevent outflow of liquid from said liquid delivery pipe when liquid is forced down said delivery pipe, and a remote unit arranged as a liquid delivery pump positionable in said well having a pair of double-acting cylinders with pistons therein coupled through a hollow connecting rod, said control pipe being connected to a first of said double-acting cylinders to force the piston therein outward to expel liquid from its other side into the said delivery pipe, said delivery pipe being connected to the other end of said first cylinder, a foot valve in said second of said double-acting cylinders to allow the cylinder to be charged with liquid when liquid is forced down the said liquid delivery pipe to move the said coupled pistons outwards, and valve means and at least a port in the said hollow connecting rod to force liquid from the second of said cylinders through the said hollow connecting rod into said delivery pipe, whereby liquid taken into said second cylinder is discharged through the said valve means of the said surface unit when liquid is urged down the said control pipe.

* * * * *

UNITED STATES PATENT AND TRADEMARK OFFICE

CERTIFICATE OF CORRECTION

PATENT NO. : 4,462,763

DATED : July 31, 1984

INVENTOR(S) : Donald I. MacLeod

It is certified that error appears in the above-identified patent and that said Letters Patent is hereby corrected as shown below:

Column 4, Claim 1, line 11, delete "liquid delivery" and substitute therefor --control--.

Column 4, Claim 1, line 13, delete "control" and substitute therefor --liquid delivery--.

Signed and Sealed this

Eleventh Day of August, 1987

*Attest:*

DONALD J. QUIGG

*Attesting Officer*

*Commissioner of Patents and Trademarks*